US006474301B1

(12) United States Patent
Kamimura et al.

(10) Patent No.: US 6,474,301 B1
(45) Date of Patent: Nov. 5, 2002

(54) THROTTLE CONTROLLING DEVICE

(75) Inventors: Yasuhiro Kamimura, Hitachinaka; Yasushi Sasaki, Naka-gun; Norio Tomita, Hitachinaka; Tsugio Tomita, Hitachi; Syuuichi Nakano, Hitachinaka, all of (JP)

(73) Assignee: Hitachi, Ltd., Tokyo (JP)

( * ) Notice: Subject to any disclaimer, the term of this patent is extended or adjusted under 35 U.S.C. 154(b) by 32 days.

(21) Appl. No.: 09/652,659

(22) Filed: Aug. 31, 2000

(30) Foreign Application Priority Data

Sep. 1, 1999 (JP) ..... 11-247287

(51) Int. Cl.[7] ..... F02D 9/02
(52) U.S. Cl. ..... 123/396; 123/399; 123/361
(58) Field of Search ..... 123/396, 399, 123/361, 400, 377; 73/117.3; 701/114

(56) References Cited

U.S. PATENT DOCUMENTS 4,833,613 A * 5/1989 Mack et al. ..... 701/105
5,036,808 A * 8/1991 Stumpp ..... 123/198 D
5,056,022 A * 10/1991 Witkoski et al. ..... 701/101
5,138,874 A * 8/1992 Davis ..... 73/118.1
5,170,860 A * 12/1992 Suzuki et al. ..... 123/399
5,204,816 A * 4/1993 Wright et al. ..... 123/479
5,960,771 A * 10/1999 Watannabe ..... 123/396

FOREIGN PATENT DOCUMENTS

| | | |
|---|---|---|
| JP | 61-8441 | 6/1984 |
| JP | 10-306735 | 5/1997 |
| JP | 10238370 | 9/1998 |

* cited by examiner

*Primary Examiner*—Henry C. Yuen
*Assistant Examiner*—Hieu T. Vo
(74) *Attorney, Agent, or Firm*—Crowell & Moring LLP

(57) ABSTRACT

An electronic control throttle body has a default mechanism for securing the self-propelling of a vehicle at the time of faulty. A throttle control unit controls the position of a throttle valve by using a motor on the basis of a target throttle valve opening degree obtained by an engine control unit. In this respect, when the target throttle valve opening degree inputted from the engine control unit crosses over a default opening degree fÆ0 of a default mechanism, an integration value having been added is set to 0, and an integration value having been calculated hereinafter is added to the set value to thereby perform a feedback control.

4 Claims, 4 Drawing Sheets

THROTTLE CONTROLLING DEVICE

BACKGROUND OF THE INVENTION

The present invention relates to a throttle control apparatus which electronically controls a control valve for controlling a suction air amount of an internal combustion engine mounted on a vehicle by using an actuator such as a motor etc.

In recent years, the throttle control apparatus for a vehicle has been shifting from the one employing the method of mechanically controlling the position of a throttle valve in an interlocked manner with an acceleration pedal to the one of an electronic control type which electronically controls a throttle valve by using an actuator such as a motor etc. to supply an optimum amount of air in accordance with the operation condition of an engine. Such a conventional throttle control apparatus of an electronic control type is arranged in a manner, as described in JP-A-61-8441, for example, that a signal relating to an operation condition such as an output signal of an acceleration sensor for detecting a depressed amount of an acceleration pedal is subjected to the calculation processing thereby to set a target throttle opening degree of a control valve. Further, in this throttle control apparatus, a throttle sensor for detecting the position of the control valve is provided, then an actual throttle valve opening degree is calculated from the output value of the throttle sensor, and the position of the control valve is subjected to the feedback control by using an actuator such as a motor etc. until the actual throttle valve opening degree becomes equal to the target throttle valve opening degree.

Further, another conventional throttle control apparatus of an electronic control type is arranged in a manner, as described in JP-A-10-306735, for example, that it is required to secure the safety of a throttle body to be controlled since the throttle position control operation of the throttle body is entirely performed by using electric signals, and a default mechanism for mechanically supplying an air amount capable for self-propelling is provided so that a vehicle can move to a repair shop when the apparatus becomes faulty.

SUMMARY OF THE INVENTION

However, the conventional throttle body provided with the default mechanism is configured in a manner that, when an abnormality of a sensor etc. occurs, a power source for the actuator driving system is cut off and the throttle valve is mechanically restored to a default opening degree due to the biasing force of a spring etc. Thus, the throttle body is arranged to have a non-linear axial torque characteristics. Further, the throttle valve is controlled in a manner that the throttle body having the non-linear axial torque characteristics is controlled by employing a control method such as a PID feedback control etc.

The integration item serving for converging the subject to be controlled to the target throttle valve opening degree has a second order lag characteristic and also has a non-linear characteristic since the controlled subject system has a non-linear characteristic due to the default mechanism. Thus, it takes a long time for the integration value to converge. In particular, when performing such a response that the target throttle valve opening degree crosses over the default opening degree, there arises a problem that the response time and the converging time become large.

Accordingly, an object of the present invention is to provide a throttle controlling device which can obviate the aforesaid problem of the prior art.

Another object of the present invention is to provide a throttle controlling device which can make both the response time and the converging time shorter.

(1) In order to attain the aforesaid object, according to an aspect of the present invention, the present invention is arranged in a manner that in a throttle control apparatus which controls a position of a throttle valve of an electronic control throttle body having a default mechanism for securing self-propelling of a vehicle at a time of faulty by using an actuator on a basis of a target throttle valve opening degree obtained by an engine control unit, when a target throttle valve opening degree inputted from the engine control unit crosses over a default opening degree of the default mechanism, a correction value having been added is set to an initial setting value, and a correction value having been calculated hereinafter is added to the initial setting value to thereby perform a feedback control.

According to such an arrangement, when the target throttle valve opening degree crosses over the default opening degree, the correction value is set to the initial setting value, so that the response using an integration item can be made quicker and so both the response time and the converging time can be made shorter.

(2) In the arrangement of (1), preferably, the initial setting value is set to 0.

(3) In the arrangement of (1), preferably, a dead band area including the default opening degree is provided, and when the target throttle valve opening degree inputted from the engine control unit crosses over the dead band area, an integration value having been added is set to an initial setting value, and an integration value having been calculated hereinafter is added to the initial setting value to thereby perform a feedback control.

(4) In the arrangement of (3), preferably, a value of the dead band is ±1.5 degrees.

DETAILED DESCRIPTION OF PREFERRED EMBODIMENTS

The configuration of the throttle control apparatus according to an embodiment of the invention will be explained with reference to FIGS. 1 to 4

First, the entire configuration of the throttle control apparatus according to the embodiment will be explained with reference to FIG. 1.

Figure 1:
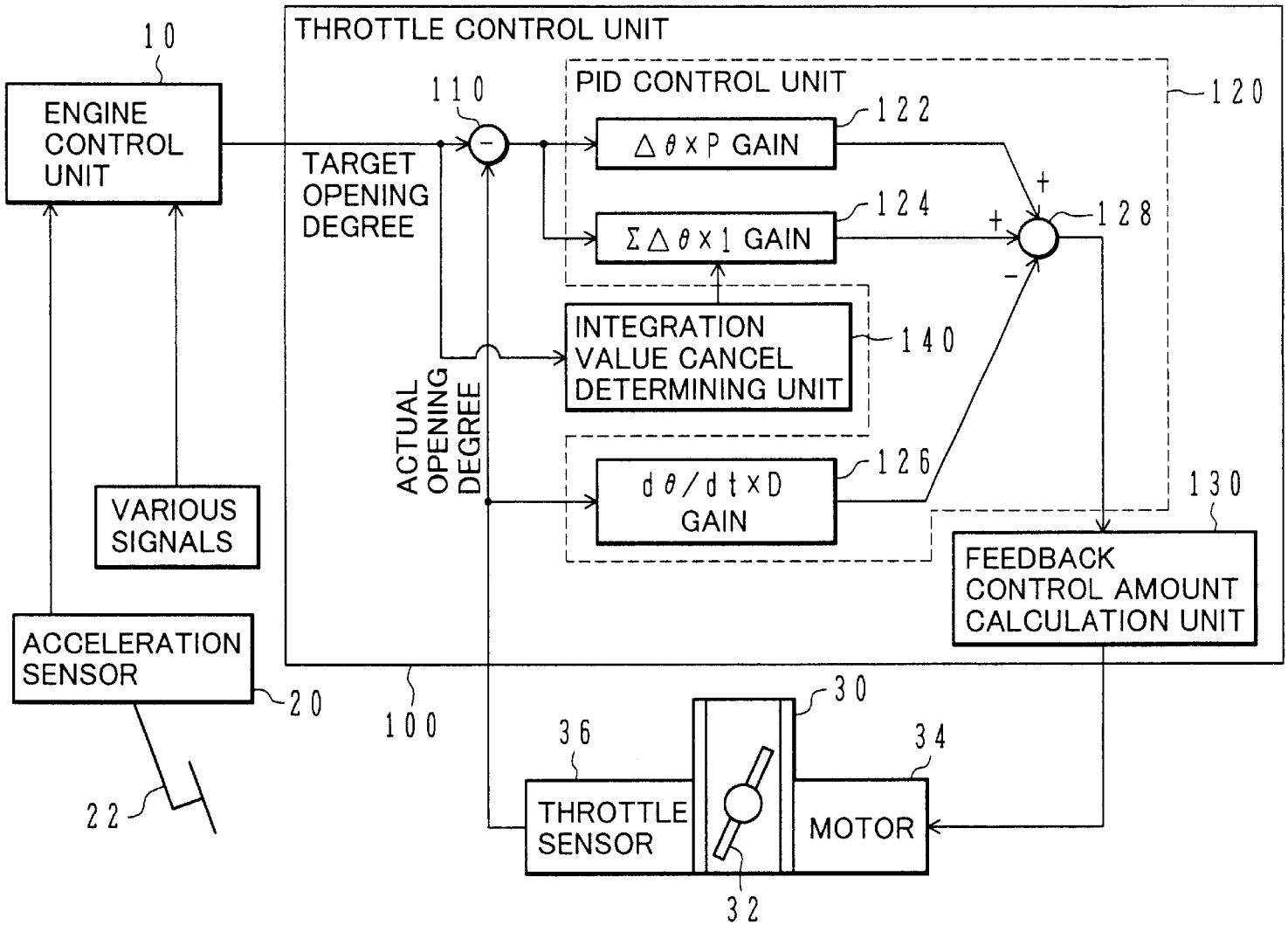
FIG. 1 is a block diagram showing the entire configuration of the throttle control apparatus according to an embodiment of the present invention.

FIG. 1 is a block diagram showing the entire configuration of the throttle control apparatus according to the embodiment of the invention.

An engine control unit 10 calculates a target throttle valve opening degree for supplying an optimum amount of air for an internal combustion engine on a basis of signals from various kinds of sensors such as an acceleration sensor 20 for detecting the position of an acceleration pedal 22 and supplies the calculated value to a throttle control unit 100.

The throttle control unit 100 supplies a drive signal to a motor 34 for rotating a throttle valve 32 provided in an electronic control throttle body 30 on the basis of the target throttle valve opening degree to control the position of the throttle valve. The opening degree of the throttle valve 32 is detected by a throttle sensor 36 and the detected opening degree is transmitted to the throttle control unit 100 as an actual throttle valve opening degree signal. The throttle control unit 100 calculates the actual throttle valve opening degree on the basis of the actual throttle valve opening degree signal and the position of the control valve is subjected to the feedback control so that the actual throttle valve opening degree converges to the target throttle valve opening degree.

The throttle control unit 100 includes a subtracting unit 110, a PID control unit 120, a feedback control amount calculation unit 130 and an integration value cancel determining unit 140.

The subtracting unit 110 calculates a difference between the target throttle valve opening degree and the actual throttle valve opening degree and outputs the difference thus calculated to the PID control unit 120.

The PID control unit 120 is formed by a proportional item calculation unit 122, an integration item calculation unit 124, a differentiation item calculation unit 126 and an addition/subtraction unit 128. The proportional item calculation unit 122 multiplies the deviation ($\Delta\theta$) between the target throttle valve opening degree and the actual throttle valve opening degree by a proportional gain (P gain) to obtain a proportional item. The integration item calculation unit 124 multiplies an integration value ($\Sigma\Delta\theta$) of the deviation ($\Delta\theta$) between the target throttle valve opening degree and the actual throttle valve opening degree by an integration gain (I gain) to obtain an integration item. The differentiation item calculation unit 126 multiplies a changing rate ($d\theta/dt$) of the actual throttle valve opening degree by a differentiation gain (D gain) to obtain a differential item. The addition/subtraction unit 128 obtains the sum of the output value of the proportional item calculation unit 122 and the output value of the integration item calculation unit 124, then subtracts the output value of the differentiation item calculation unit 126 from the sum thus obtained to obtains a subtraction value and outputs the subtraction value as a PID control signal to the feedback control amount calculation unit 130.

The feedback control amount calculation unit 130 calculates a feedback control amount on the basis of the PID control signal thereby to output the feedback control amount thus calculated to the motor 34.

Further, this embodiment is characterized by being provided with the integration value cancel determining unit 140. The integration value cancel determining unit 140 monitors the target throttle valve opening degree to thereby determine whether the target throttle valve opening degree crosses over the default opening degree at the moment the target throttle valve opening degree changes. When it is determined that the target throttle valve opening degree crosses over the default opening degree, the integration value cancel determining unit sets the integration value of the integration item calculation unit 124 serving as a correction value to 0.

The default opening degree of the electronic control throttle body will be explained with reference to FIG. 2.

Figure 2:
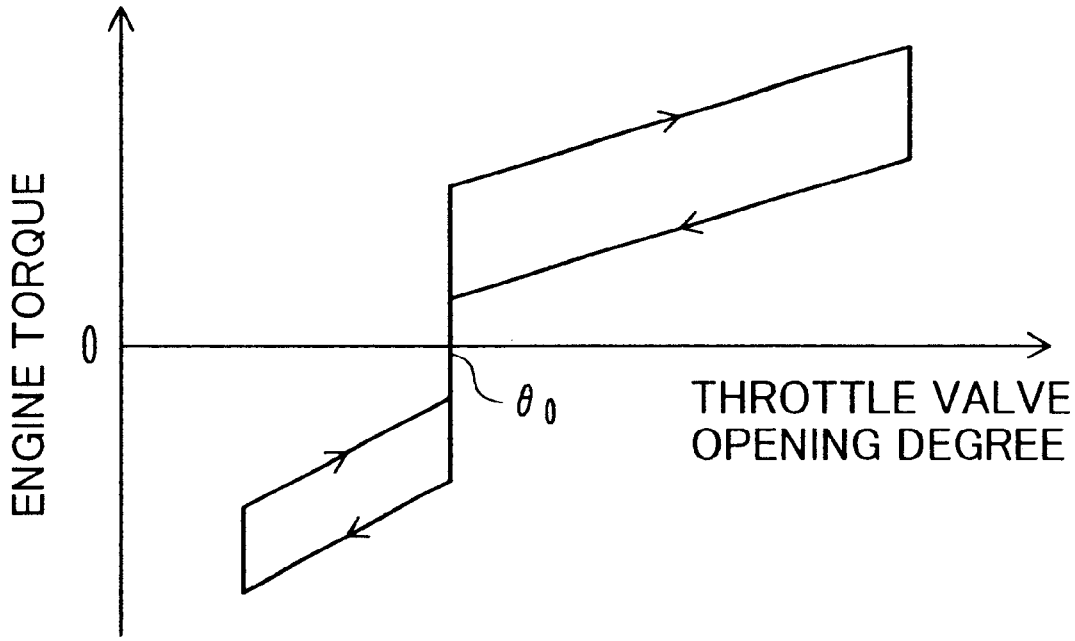
FIG. 2 is a diagram for explaining the default opening degree of the electronic control throttle body used in the throttle control apparatus according to the embodiment of the present Invention.

FIG. 2 is a diagram for explaining the default opening degree of the electronic control throttle body used in the throttle control apparatus according to the embodiment of the invention. In FIG. 2, the abscissa represents the throttle valve opening degree and the ordinate represents the axial torque.

The electronic control throttle body 30 is configured in a manner that, when an abnormality etc. occurs in the motor 34 etc., a power source for the motor 34 is cut off and the throttle valve is mechanically restored to the default opening degree due to the biasing force of a spring etc. Thus, the electronic control throttle body 30 is arranged to have a non-linear axial torque characteristics as shown in FIG. 2.

That is, when the throttle valve opening degree is at the default opening degree $\theta$0, the axial torque is 0. Thus, the electronic control throttle body has such a characteristics that when the power source for the motor 34 is cut off, the throttle valve is restored to the default opening degree $\theta$0. In a range where the throttle valve opening degree is larger than the default opening degree $\theta$0, the electronic control throttle body has such a characteristics that the axial torque increases in accordance with the increase of the throttle valve opening degree and also provided with hysteresis characteristics. Further, in a range where the throttle valve opening degree is smaller than the default opening degree $\theta$0, the electronic control throttle body has such a characteristics that the axial torque increases to the negative side in accordance with the decrease of the throttle opening degree and also provided with hysteresis characteristics. In other words, the axial torque changes abruptly from the negative side to the positive side through the default opening degree $\theta$0. In this respect, although the default opening degree $\theta$0 differs depending on the kind of the electronic control throttle body 30, this opening degree is in a range of 7 to 15 degrees, in general.

Since the electronic control throttle body 30 has the torque characteristics shown in FIG. 2, when performing such a response that the target throttle valve opening degree crosses over the default opening degree, the integration item calculation unit 124 has the integration values of negative and positive polarities. Thus, the control amount necessary for operating the throttle valve is calculated to a value smaller than the actually required amount until the integration value having been integrated is consumed and the polarity of the integration value changes. Such a fact not only influences on the response time but also causes a problem that it takes a much time to converge the integration value to such a value necessary for holding the actual throttle valve opening degree to the target throttle valve opening degree. As a result, when performing such a response that the target throttle valve opening degree crosses over the default opening degree, the integration value having the lag characteristics delays in the response time and the converging time in addition to the mechanical torque characteristics, which causes the degradation of the control characteristics.

Then, the explanation will be made with reference to FIG. 3 as to the behaviors of the actual throttle valve opening degree and the calculated integration value in the case where the electronic control throttle body 30 having the non-linear axial torque characteristics shown in FIG. 2 is controlled.

Figure 3:
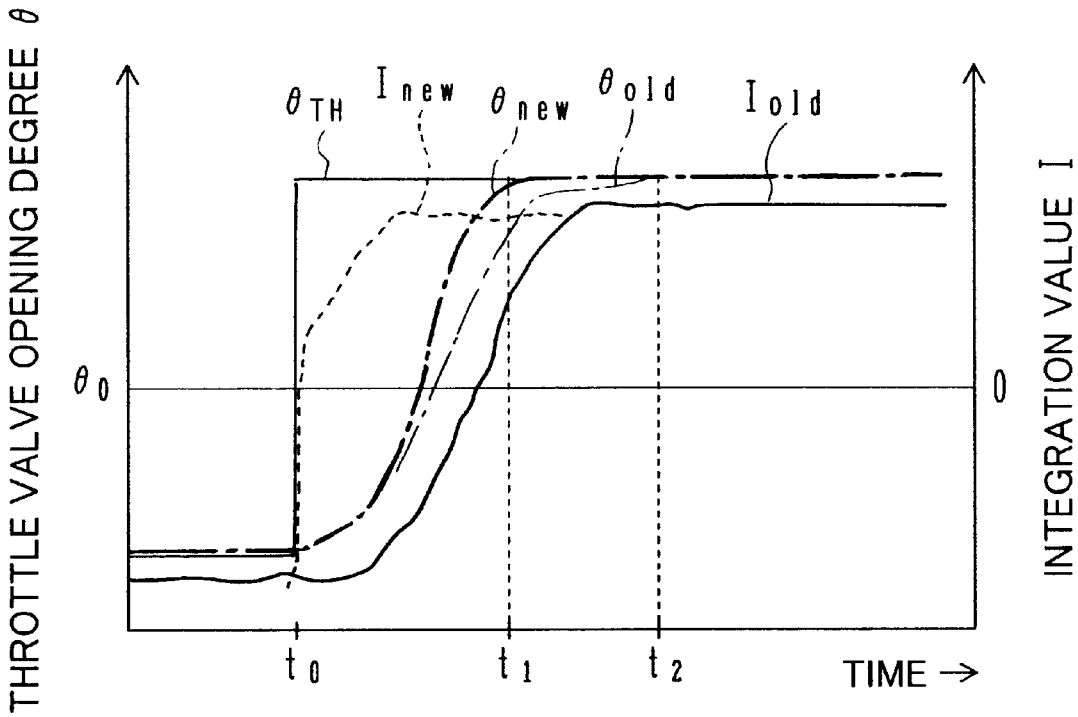
FIG. 3 is a diagram for explaining the behaviors of an actual throttle valve opening degree and a calculated integration value in the case where the electronic control throttle body is controlled.

FIG. 3 is a diagram for explaining the behaviors of the actual throttle valve opening degree and the calculated integration value in the case where the electronic control throttle body is controlled. In FIG. 3, the abscissa represents the time and the ordinate represents the throttle valve opening degree and the integration value.

Explanation will be made as to the case where the target throttle valve opening degree θTH transmitted from the engine control unit 10 crosses over the default opening degree θ0 at the time t0 as shown by a solid line, that is, the target throttle valve opening degree changes from a value smaller than the default opening degree θ0 to a value larger than the default opening degree θ0. In this case, according to the conventional method, the actual throttle valve opening degree θold is operated on the basis of the control amount calculated by the PID feedback control as shown by a two dot-and-dashed line, and so the actual throttle valve opening degree changes as shown in FIG. 3. Further, in this case, the integration value Iold according to the conventional method changes with a time lag with respect to the operation of the actual throttle valve opening degree θold as shown by a solid line.

In this respect, since the integration value itself has the second order lag characteristics and the electronic control throttle body 30 has the torque characteristics shown in FIG. 2, when particularly performing such a response that the target throttle valve opening degree crosses over the default opening degree, the integration value has both the negative and positive polarities. Thus, the control amount necessary for operating the throttle valve is calculated to a value smaller than the actually required amount until the integration value having been added is consumed and the polarity of the integration value changes. Such a fact not only influences on the response time but also causes a problem that it takes a much time to converge the integration value to such a value necessary for holding the actual throttle valve opening degree to the target throttle valve opening degree.

As a result, when performing such a response that the target throttle valve opening degree crosses over the default opening degree, the integration value having the lag characteristics delays in the response time and the converging time t2 in addition to the mechanical torque characteristics, which causes the degradation of the control characteristics.

In view of the aforesaid conventional problem, according to the embodiment, the integration value cancel determining unit 140 monitors the target throttle valve opening degree to thereby determine whether the target throttle valve opening degree crosses over the default opening degree at the moment the target throttle valve opening degree changes. When it is determined that the target throttle valve opening degree crosses over the default opening degree, the integration value cancel determining unit sets the integration value of the integration item calculation unit 124 serving as a correction value to 0. That is, when the integration value cancel determining unit 140 determine that the target throttle valve opening degree crosses over the default opening degree at the moment the target throttle valve opening degree changes, the integration value cancel determining unit sets the integration value serving as the correction value to 0, so that the time required for consuming the integration value becomes zero at the time of changing the throttle opening degree from the positive side to the negative side or from the negative side to the positive side. Accordingly, the time required for converging the integration time becomes shorter, so that not only the response time becomes shorter but also the converging time becomes shorter and hence the control characteristics is improved..

As shown in FIG. 3, according to the embodiment, when the target throttle valve opening degree θTH transmitted from the engine control unit 10 changes to cross over the default opening degree θ0 at the time to as shown by the solid line, the integration calculation of an integration value Inew is started from an integration value 0 almost at the time t0 as shown by a dotted line. As a result, an actual throttle valve opening degree Onew increases quickly as shown by a dot-and-dashed line as compared with the conventional actual throttle valve opening degree θold, so that not only the response time becomes shorter but also the converging time t1 becomes shorter and hence the control characteristics is improved.

The method of determining the target throttle valve opening degree by using the integration value cancel determining unit 140 according to the embodiment will be explained with reference to FIG. 4.

Figure 4:
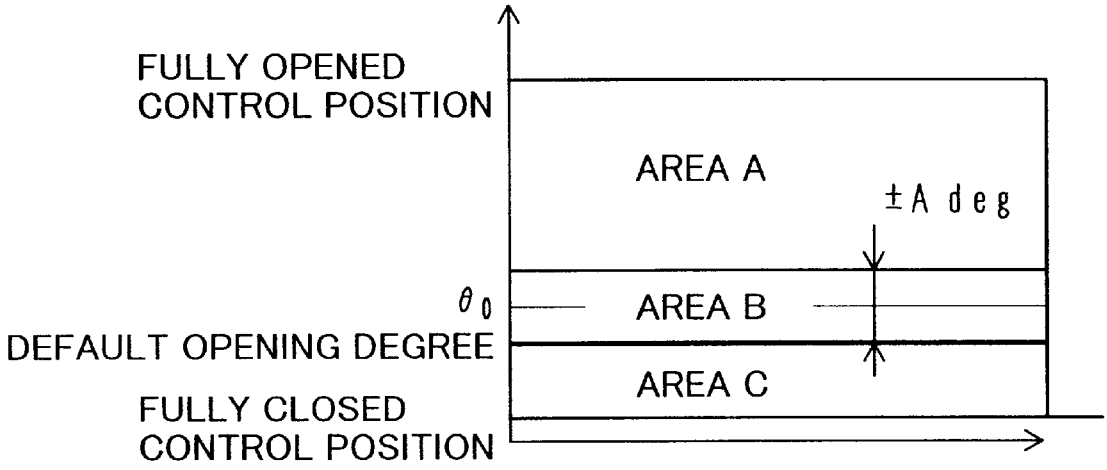
FIG. 4 is a diagram for explaining the method of determining a target throttle valve opening degree by using an integration value cancel determining means in the throttle control apparatus according to the embodiment of the present invention.

FIG. 4 is a diagram for explaining the method of determining the target throttle valve opening degree by the integration value cancel determining unit in the throttle control apparatus according to the embodiment of the present invention.

According to the embodiment, the area of the throttle valve opening degree for the determination is divided into three areas, that is, an area A, an area B and an area C as shown in the figure. The area B is an area in a range of ±A degrees with respect to the default opening degree θ0. The A degree is 1.5 degree, for example. This degree is set to the maximum value of the error of the mechanical system between the design value of the default opening degree and the default opening degree of the actual electronic control throttle body. The area A is in a range from the minimum opening degree of the area B to the fully closed position of the throttle valve. The area C is in a range from the maximum opening degree of the area B to the fully opened position of the throttle valve.

The control area of the throttle valve opening degree is divided into these areas A, B and C by the following reason. That is, since the learning of the default point is not performed, there arises a difference between the default opening degree set by using the software and the actual mechanical default opening degree. Thus, there may arise such a phenomenon that the target throttle valve opening degree crosses over the default opening degree set by the software but does not cross over the actual mechanical default opening degree or vice versa. Therefore, in order to avoid such a phenomenon influencing on the operation of the throttle valve, a dead band such as the area B is provided so that even when the target throttle valve opening degree is set in the range of ±A degrees with respect to the default opening degree so as to cross over the default opening degree, the integration value is not set to 0.

The integration value cancel determining unit 140 monitors the inputted target throttle valve opening degree to thereby determine whether the target throttle valve opening degree is changed from the area A to the area C or from the area C to the area A. The integration value cancel determining unit sets the integration value to 0 only when it is determined that the target throttle valve opening degree to be shifted between the areas A and C is inputted, whilst, in the remaining cases, performs the adding calculation for the integration value as usual.

Although in the aforesaid explanation, the integration value is set to 0 when the target throttle valve opening degree to be shifted between the areas A and C is inputted, the integration value may be preset to a predetermined initial integration value other than 0. The initial integration value can be set on the basis of the axial torque of the electronic control throttle body and the torque characteristics of the motor. For example, when the target throttle valve opening degree changes from the closed side to the opened side of the throttle valve (from the area A to the area C), 5% of the integration value Imax corresponding to the fully-opened state of the throttle valve is set as the initial integration value. In contrast, when the target throttle valve opening degree changes from the opened side to the closed side of the throttle valve (from the area C to the area A), 5% of the integration value Imin corresponding to the fully-closed state of the throttle valve is set as the initial integration value.

Further, the initial integration may be changed between the case where the target throttle valve opening degree changes from the closed side to the opened side and the case where the target throttle valve opening degree changes from the opened side to the closed side. For example, when the target throttle valve opening degree changes from the closed side to the opened side of the throttle valve, 6% of the integration value Imax corresponding to the fully-opened state of the throttle valve may be set as the initial integration value. In contrast, when the target throttle valve opening degree changes from the opened side to the closed side of the throttle valve, 4% of the integration value Imin corresponding to the fully-closed state of the throttle valve may be set as the initial integration value.

As explained above, according to the embodiment of the present invention, in the controlling of the electronic control throttle body having the non-linear axial torque characteristics due to the provision of the default mechanism, when receiving the target throttle valve opening degree crossing over the default opening degree, the integration value having been added is set to the initial setting value, so that the response operation of the throttle valve can be improved.

As described above, according to the present invention, both the response time and the converging time can be made shorter.

What is claimed is:

1. In a throttle control apparatus which controls a position of a throttle valve of an electronic control throttle body having a default mechanism for securing self-propelling of a vehicle at a time of faulty by using an actuator on a basis of a target throttle valve opening degree obtained by an engine control unit, wherein when a target throttle valve opening degree inputted from said engine control unit crosses over a default opening degree of said default mechanism, a correction value having been added is set to an initial setting value, and a correction value having been calculated hereinafter is added to the initial setting value to thereby perform a feedback control.

2. A throttle control apparatus according to claim 1, wherein said initial setting value is 0.

3. A throttle control apparatus according to claim 1, wherein a dead band area including said default opening degree is provided, and when the target throttle valve opening degree inputted from said engine control unit crosses over said dead band area, an integration value having been added is set to the initial setting value, and an integration value having been calculated hereinafter is added to the initial setting value to thereby perform a feedback control.

4. A throttle control apparatus according to claim 3, wherein a value of said dead band is ±1.5 degrees.

* * * * *